US006601572B2

(12) United States Patent
Okamoto

(10) Patent No.: US 6,601,572 B2
(45) Date of Patent: Aug. 5, 2003

(54) JOINT STRUCTURE FOR AN BLOW-BY GAS PASSAGE

(75) Inventor: Yasuo Okamoto, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/682,649

(22) Filed: Oct. 2, 2001

(65) Prior Publication Data

US 2002/0134361 A1 Sep. 26, 2002

(30) Foreign Application Priority Data

Nov. 20, 2000 (JP) ..... 2000-352232

(51) Int. Cl.[7] ..... F01D 25/02
(52) U.S. Cl. ..... 123/572
(58) Field of Search ..... 123/572, 573, 123/574

(56) References Cited

U.S. PATENT DOCUMENTS 4,205,642 A 6/1980 Nishimura et al.
5,551,409 A * 9/1996 Sanders ..... 123/572
5,761,905 A 6/1998 Yamada et al.
5,884,612 A * 3/1999 Takeyama et al. ..... 123/572

FOREIGN PATENT DOCUMENTS

| | | |
|---|---|---|
| DE | 3932300 | 4/1991 |
| EP | 0503580 | 9/1992 |
| EP | 0816666 | 1/1998 |

OTHER PUBLICATIONS

European Search Report dated Feb. 11, 2002.
Patent Abstracts of Japan vol. 1999, No. 09, Jul. 30, 1999 & JP 11 093635A (Kubota Corp), Apr. 6, 1999.
Patent Abstracts of Japan vol. 1999, No. 03, Mar. 31, 1999 & JP 10 331621A (Suzuki Motor Corp), Dec. 15, 1998.
Patent Abstracts of Japan vol. 2000, No. 25, Apr. 12, 2001 & JP 2001 214995A (Pacific Ind Co Ltd), Aug. 10, 2001.

* cited by examiner

*Primary Examiner*—Marguerite McMahon
(74) *Attorney, Agent, or Firm*—Ernest A. Beutler

(57) ABSTRACT

Several embodiments of fittings or couplings for the crankcase ventilating gas return to the combustion chambers through the induction system. They each provide good insulation so as to avoid the likelihood that water condensation in the path can freeze and restrict the ventilating flow.

11 Claims, 6 Drawing Sheets

JOINT STRUCTURE FOR AN BLOW-BY GAS PASSAGE

BACKGROUND OF INVENTION

This invention relates to an internal combustion engine and more particularly to a crankcase ventilating system for internal combustion engines.

In order to reduce the emission of unwanted hydrocarbons and other combustible material to the atmosphere from internal combustion engines, it has been the practice to ventilate the crankcase of the engine by the blow-by gases that pass across the piston rings and into the crankcase chamber. These blow-by gases are then collected and returned by a crankcase ventilating system that normally utilizes a positive crankcase ventilating (PCV) valve to the induction system of the engine. Thus these gases are returned to the combustion chamber and further combustion of the undesirable constituents occurs.

A problem with this type of positive crankcase ventilating system is that when the gases are returned to the induction system and under low ambient temperatures, not only is the induction system but the entire engine at a relatively low temperature, particularly when it is initially started. Since the ventilating gases also include a fair amount of water vapor, they can not only condense but also can solidify in the crankcase ventilating conduit and cause significant problems.

This problem may be best understood by reference to FIG. 1, which is a partial cross sectional view showing the conventional type of crankcase ventilating system. The engine, indicated generally by the reference numeral 11, is provided with an internal crankcase ventilating system which includes an arrangement for returning blow-by gases to an area such as the valve cover 12 which is provided with an oil separator, shown partially at 13, for returning lubricant to the crankcase. The gases exist the cam chamber enclosed by the cam cover 12 through a first metallic fitting 14 onto which one end of a flexible hose 15 is positioned. The opposite end of the flexible hose 15 is connected to a further fitting 16, which communicates with the interior of an air inlet device 17 that collects atmospheric air for delivery to the engine combustion chambers.

Because of the aforenoted problems in connection with condensation and freezing, an insulating sleeve 18 frequently is employed encircling the flexible conduit 15 in the area between the metallic fittings 14 and 16. In spite of this insulation, water vapor in the blow-by gases, which flow in the direction of the arrow shown in this figure, can condense particularly in the area where the fitting 16 joins the air inlet device 17. Thus, ice particles indicated at 19 can form in this area and either restrict or in extreme cases totally cut off the re-circulating air flow. Various arrangements have been proposed for attempting to avoid this problem, but they have not been totally effective and in many instances can be expensive.

It is, therefore, a principle object to this invention to provide an improved crankcase ventilating system for an internal combustion engine.

It is a specific object to this invention to provide a simple and effective heat insulating arrangement for connecting the crankcase ventilating tube to the induction system of the engine that will provide adequate insulation to preclude the likelihood of freezing even under extremely low ambient temperatures.

SUMMARY OF INVENTION

This invention is adapted to be embodied in an internal combustion engine and crankcase ventilating system therefore. The engine includes an induction system for collecting atmospheric air and delivering the collected air to at least one combustion chamber of the engine. A crankcase ventilating system collects and exhausts blow-by gases from the engine and returns them to the combustion chamber through the induction system for reducing undesirable emissions to the atmospheric. This crankcase ventilating system communicates with the induction system through a fitting having a double wall construction comprised of an inner tube received in an outer tube with the outer wall of the inner tube being circumferentially spaced from the inner wall of the outer tube for heat insulation of the blow gases and inner tube.

DETAILED DESCRIPTION

Figure 1:
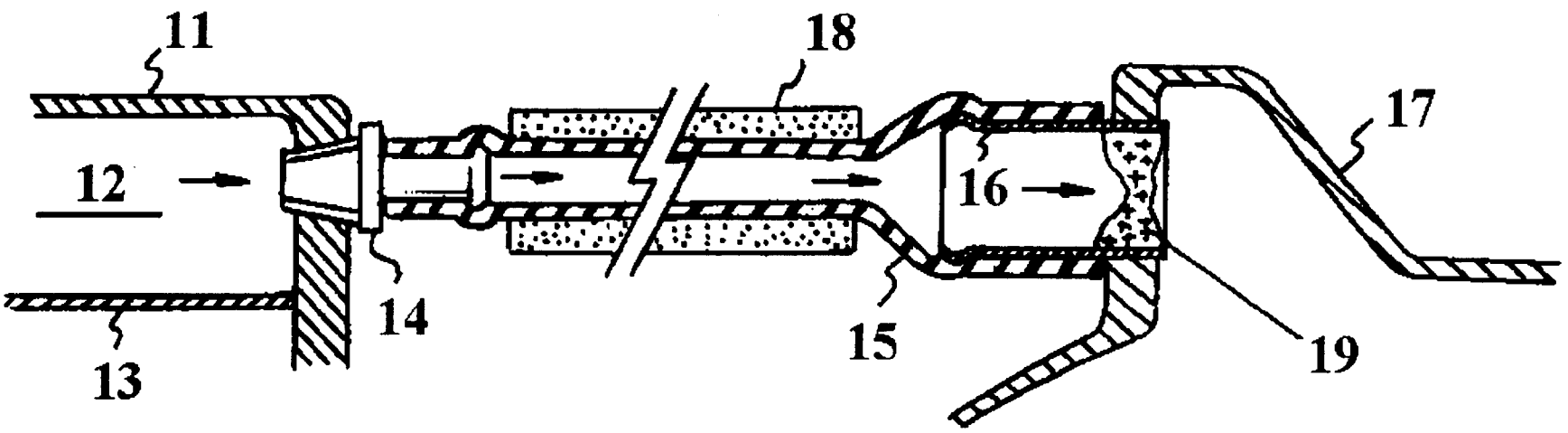
FIG. 1 (Prior Art)
FIG. 1 is a cross sectional view in partially schematic form of a prior art type of crankcase ventilating system.
Figure 2:
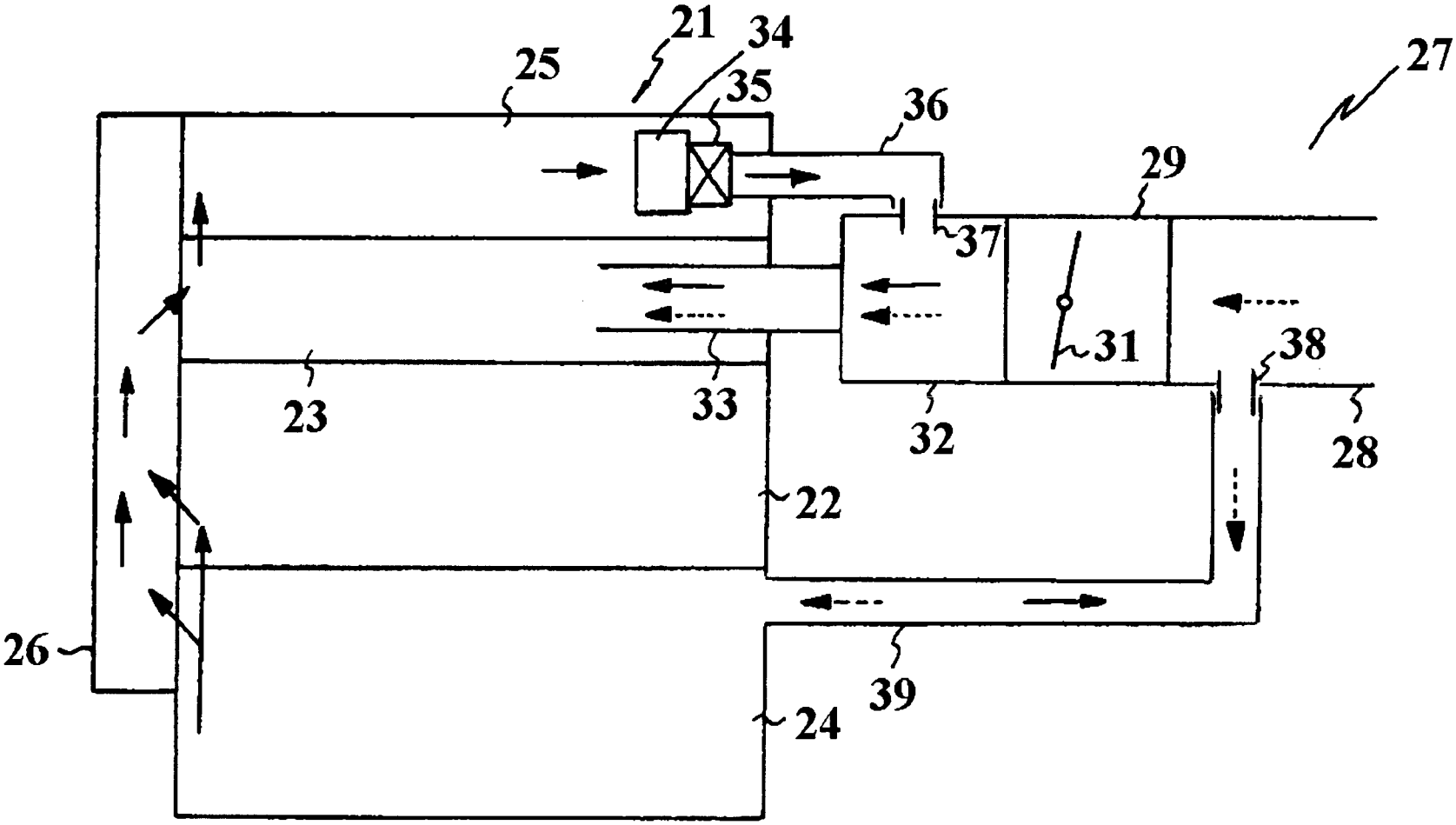
FIG. 2 is a primarily schematic view showing a crankcase ventilating system constructed in accordance with the invention.
Figure 3:
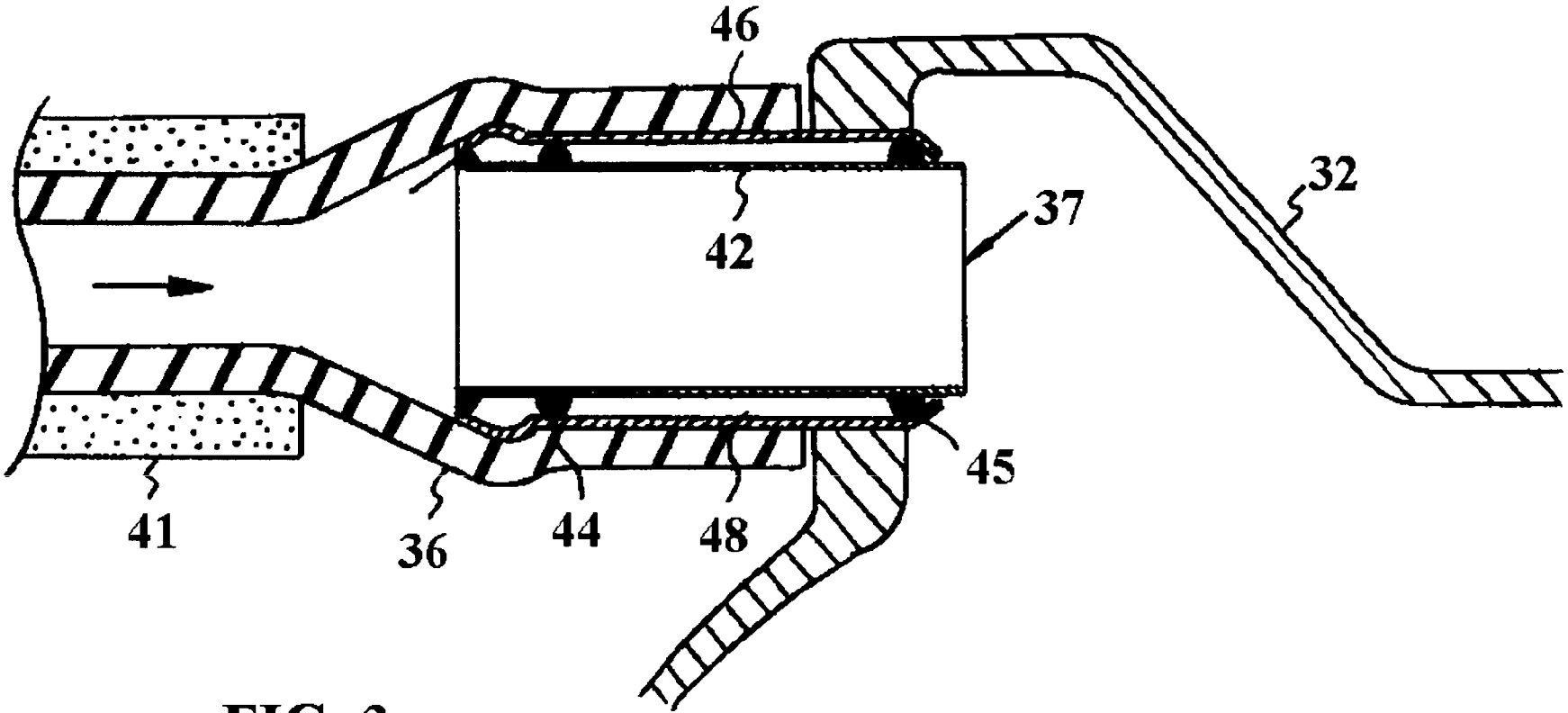
FIG. 3 is an enlarged cross sectional view, in part similar to FIG. 1, but showing a first embodiment of the invention.
Figure 4:
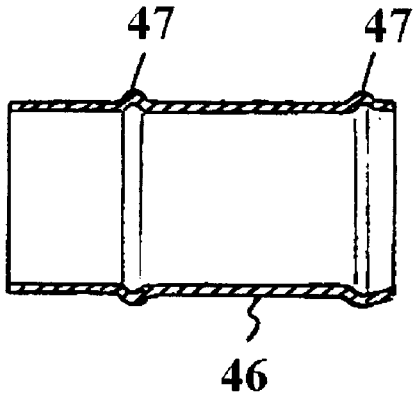
FIG. 4 is a cross sectional view taken through the outer tube of the fitting illustrated in FIG. 3 and illustrated in assembled form in FIG. 6.
Figure 5:
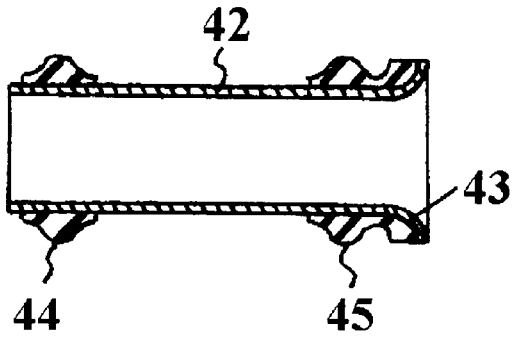
FIG. 5 is a cross sectional view of the inner tube of the fitting.

Referring first to FIG. 2, this shows schematically an internal combustion engine, indicated generally by the reference numeral 21 that shows the general structure with which the invention is practiced. The engine 21 includes a cylinder block 22 to which a cylinder head 23 is affixed in any suitable manner including being integrally formed therewith. The cylinder block 22 has one or more cylinder bores in which pistons reciprocate and which cooperate with the cylinder head 23 to form the combustion chambers of the engine. Since the internal construction of the engine forms no particular part of the invention and the invention can be utilized with a wide variety of engine types, the internal details are not illustrated.

The pistons are connected to a crankshaft, which is not shown, but which is journalled in a crankcase assembly formed by the skirt of the cylinder block 22 and a crankcase member 24 affixed thereto.

A suitable valve arrangement is incorporated in the cylinder head assembly 23 and this is covered by a cam cover 25.

Camshafts are journalled in the cylinder head 23 in a suitable manner and are driven by a timing drive that is contained within a timing case 26 affixed to the forward portion of the cylinder head 23, cylinder block 22, crankcase member 24 and cam cover 25.

An induction system is provided for delivering at least an air charge to the combustion chambers of the engine. This induction system is indicated generally by the reference numeral 27 and includes an atmospheric air inlet device 28, which draws air from the atmosphere and passes it through a filter element (not shown). This filtered air is then delivered to a throttle body 29 in which a butterfly type throttle valve 31 is rotatably positioned.

The throttle body 29 communicates with a plenum chamber 32, which, in turn, communicates with a plurality of manifold runners 33 (only one of which is shown in the drawings) that supply the air charge to the combustion chambers of the engine.

The engine 21 is provided with a crankcase ventilation system, which relies primarily upon the blow-by gases passing around the piston rings of the engine into the crankcase chamber 24 for ventilation purposes. These blow-by gases are indicated by the solid line arrows in FIG. 2 and are primarily delivered back to the induction system 27 through one of two paths. The primary path is from the crankcase 24 through suitable passages therein and/or in the cylinder block 22 to the timing case 26. The gases then pass through the cylinder head and specifically the valve chamber thereof for collection in the cam cover 25. A separator 34 is formed therein for separating the lubricating oil from the crankcase gases and returning the lubricating oil back to the lubricating system of the engine.

A PCV valve 35 cooperates with the oil separator 34 and communicates with the induction system 27 downstream of the throttle valve 31 through a flexible conduit 36, which may be suitably insulated, as will be described later, and a coupling or fitting 37 that is constructed in accordance with a first embodiment of the invention and which will be described in more detail very shortly by reference to FIGS. 3 through 6.

In addition, the air inlet device 28 has a fitting 38, which communicates with the crankcase chamber 24 through a further flexible conduit 39. Normally, flow will occur through this conduit 39 only when the engine is running under certain conditions and these crankcase gases will be returned back to the combustion chambers through the throttle body 29 and plenum chamber 32. This flow is, for the most part, minimal.

Referring now in detail to FIGS. 3 through 6, the construction of the fitting 37 will be described in detail. This figure also shows more detail of the way in which the flexible conduit 36 is connected to this fitting 37 as well as the insulating material afore referred to for the flexible conduit 36 and which is indicated by the reference numeral 41.

The fitting 37 is comprised of an inner tube 42 (see FIGS. 5 and 6) that is formed of a thin wall structure from a highly heat conductive material such as aluminum. A flange 43 is formed at one end of this inner tube 42. Received around the area contiguous to the opposite ends of the inner tube 42 are a pair of insulating rings 44 and 45, with the ring 45 being juxtaposed and engaged with the flange end 43 while the ring 44 is disposed adjacent the plain end thereof.

These insulating rings 44 and 45 may be formed from an elastromeric type of material such as rubber or the like and are adhesively bonded to the exterior surface of the inner tube 42 by vulcanization or any other suitable manner.

Figure 6:
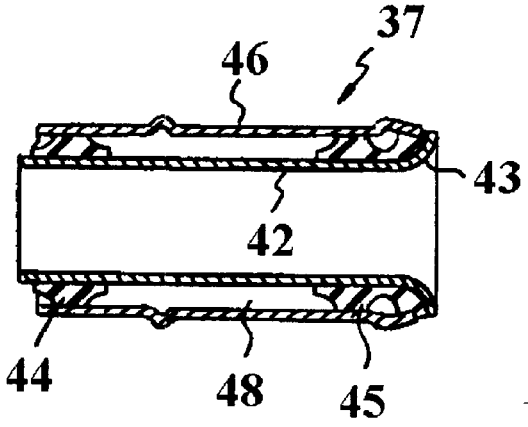
FIG. 6 is an assembled view of the fitting with the tubes of FIGS. 4 and 5 interfitted with each other.

Supported around the inner tube 42 in spaced relationship thereto is an outer tube 46. This outer tube 46 is formed from a less highly heat conductive material than the inner tube 42 and preferably has a greater wall thickness. Cast iron may be a suitable material used for this purpose. A pair of ridge like projections 47 are formed on the outer tube 46. As seen in FIG. 6, the outer tube 46 is telescopically received over the inner tube 43 and held in spaced relationship thereto by the elastic insulating rings 44 and 45.

This also forms an insulating air gap 48 around the periphery of the inner tube 42 which will be heated by the heat transmission through the inner tube 42 caused by the flow of the heated ventilating gases and blow-by gas. Thus, the open communication between the flange end 43 and the plenum chamber 32 will insure that even if there are low ambient temperatures, any water vapor in the ventilating gases will not freeze and obstruct their flow.

In this embodiment, the surge tank 32 is preferably formed also from a highly heat conductive material such as aluminum. But since it is engaged with the cast iron or less heat conductive outer sleeve 46, the heat transfer will be substantially minimized.

Figure 7:
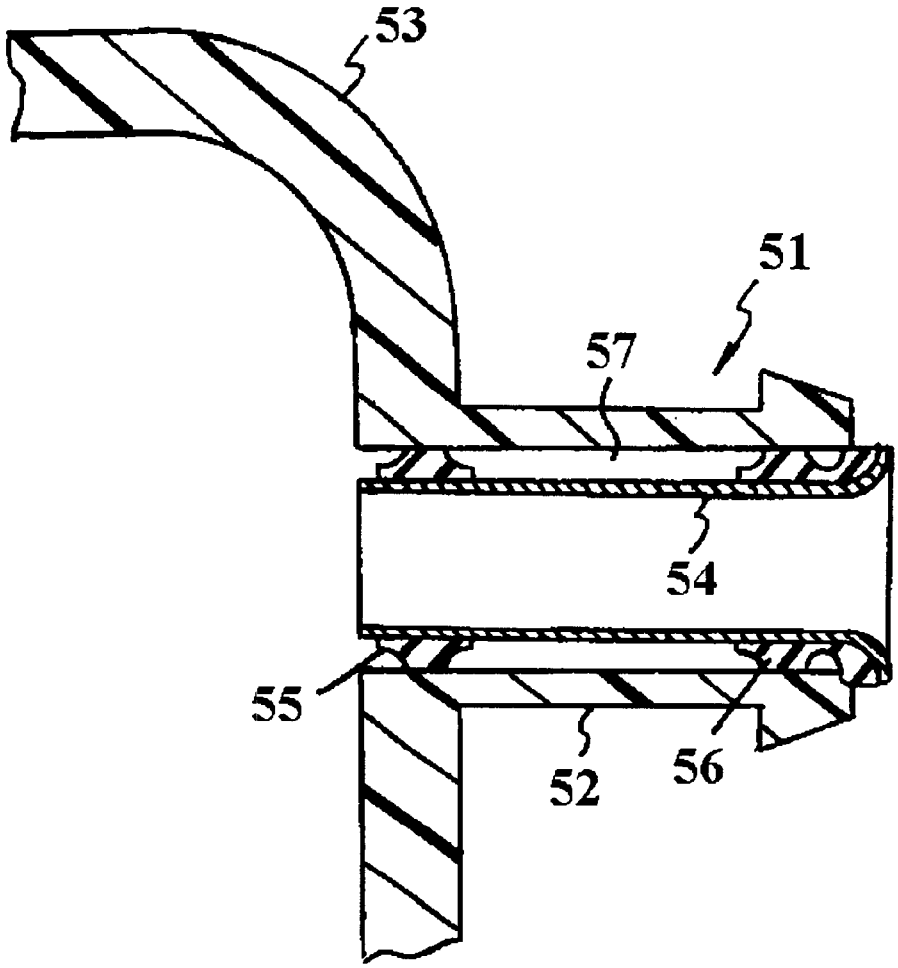
FIG. 7 is a cross sectional view of another embodiment of the invention.

A coupling formed in accordance with another embodiment of the invention is shown in FIG. 7 and is identified generally by the reference numeral 51. In this embodiment, the outer sleeve 52 is formed integrally with the plenum chamber, shown partially and indicated by the reference numeral 53. The surge tank 53 is formed from a fairly thick walled plastic material that has relatively low thermal conductivity.

An inner tube 54 again formed from aluminum of thin walled construction is held in spaced relationship to the inner surface of the outer tube 52 by means of a pair of insulating rings 55 and 56 which may be formed in the same manner and attached thereto as the rings 44 and 45 of the previously described embodiment. This inner tube 54 and insulating rings 55 and 56 are then pressed fit into the outer tube 52 to provide an insulating air gap 57 there between. Hence, this device operates substantially in the manner as that previously described.

Figure 8:
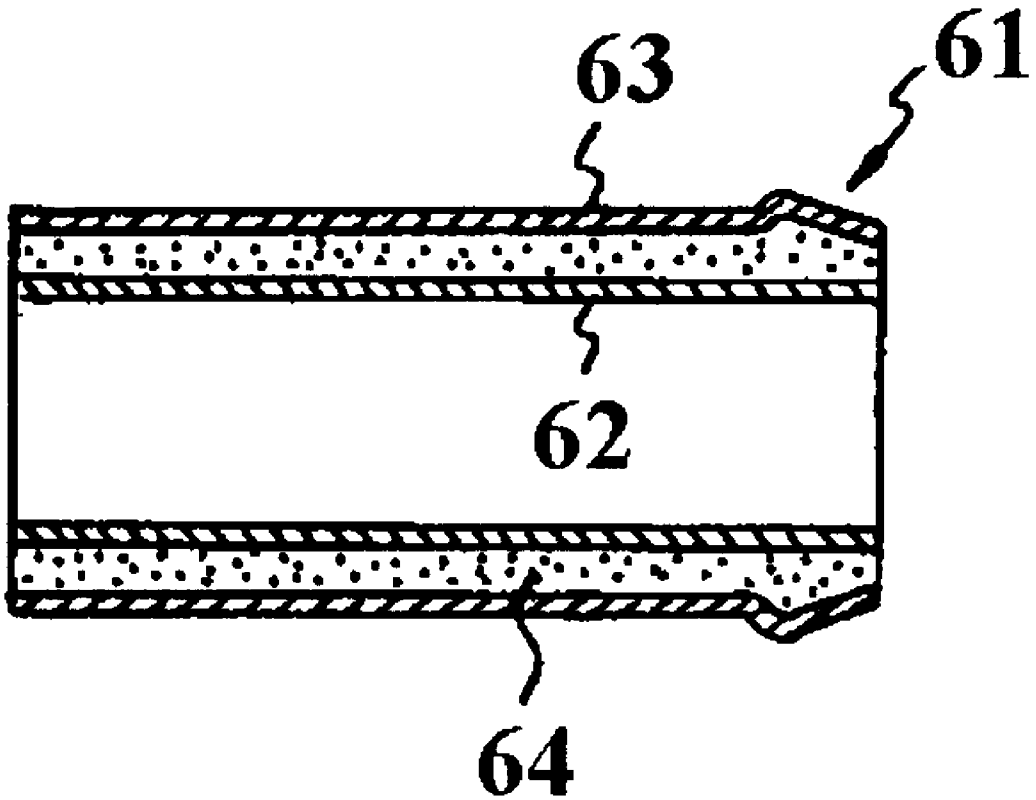
FIG. 8 is a cross sectional view of a still further embodiment of the invention.

A still further coupling embodiment is shown in FIG. 8 and is indicated generally by the reference numeral 61. In this embodiment, there are provided inner and outer tubes 62 and 63, respectively. These tubes 62 and 63 may be formed from materials previously mentioned wherein the inner tube 62 has a lesser wall thickness than the outer tube 63 and is more highly heat conductive.

In accordance with this embodiment, rather than an air gap there is provided an insulating sleeve 64 between the two tubes 62 and 63 to hold them in spaced relationship. This heat insulating material 64 may, for example, be a highly insulating expanded urethane rubber that is expanded into the space between the two tubes 62 and 63 to hold them in their spaced relationship.

Therefore, from the foregoing description, it should be readily apparent that the described embodiments of the invention all provide very effective insulating couplings between the crankcase gas return tube and the induction system and which will provide good heat transfer from the blow-by gases to the unions so as to avoid the likelihood of water vapor freezing therein and clogging the flow under low ambient conditions. Of course, the foregoing description is that of several preferred embodiments of the invention and various changes and modifications may be made without departing from the spirit and scope of the invention, as defined by the appended claims.

What is claimed is:

1. An internal combustion engine and crankcase ventilating system therefore comprising an induction system for collecting atmospheric air and delivering the collected air to at least one combustion chamber of said engine, a crankcase ventilating system for collecting and exhausting blow by gasses from said engine and returning them to said combustion chamber through said induction system for reducing undesirable emissions to the atmosphere, said crankcase ventilating system communicating with said induction system through a fitting having a double wall construction comprised of an inner tube received in an outer tube, aid outer tube being fixed at one end thereof to said induction system and receiving a flexible conduit at the other end thereof, said flexible conduit communicating at the other end thereof to receive blow by gasses from said engine, the outer wall of said inner tube being circumferentially spaced from the inner wall of said outer tube at both ends thereof for heat insulation of the blow by gasses.

2. An internal combustion engine and crankcase ventilating system as set forth in claim 1 wherein the inner tube and the outer tube are made of different materials.

3. An internal combustion engine and crankcase ventilating system as set forth in claim 1 wherein the inner tube is made of a material of less wall thickness and greater heat conductivity than the outer tube.

4. An internal combustion engine and crankcase ventilating system as set forth in claim 1 wherein the inner and outer tubes are held in spaced relation in the entire area thereof between their ends by at least one insulator.

5. An internal combustion engine and crankcase ventilating system as set forth in claim 4 wherein there are a pair of axially spaced insulators to form an insulating air gap there between.

6. An internal combustion engine and crankcase ventilating system as set forth in claim 5 wherein the insulators are positioned contiguous to the ends of one of the tubes.

7. An internal combustion engine and crankcase ventilating system as set forth in claim 6 wherein the insulators are positioned contiguous to the ends of both of the tubes.

8. An internal combustion engine and crankcase ventilating system as set forth in claim 7 wherein the inner tube and the outer tube are made of different materials.

9. An internal combustion engine and crankcase ventilating system as set forth in claim 7 wherein the inner tube is made of a material of less wall thickness and greater heat conductivity than the outer tube.

10. An internal combustion engine and crankcase ventilating system as set forth in claim 4 wherein the insulator extends to positions contiguous to the ends of one of the tubes.

11. An internal combustion engine and crankcase ventilating system as set forth in claim 10 wherein the insulator extends to positions contiguous to the ends of both of the tubes.

* * * * *